US005491282A

United States Patent [19]

Engelking et al.

[11] Patent Number: 5,491,282

[45] Date of Patent: Feb. 13, 1996

[54] APPARATUS AND METHOD FOR NEUTRALIZING A CONTAMINATED HEATING ELEMENT

[75] Inventors: Steven Engelking; Robert R. Sanchez, both of San Antonio, Tex.

[73] Assignees: Sony Corporation, Tokyo, Japan; Sony Electronics Inc., Park Ridge, N.J.

[21] Appl. No.: 293,977

[22] Filed: Aug. 22, 1994

[51] Int. Cl.[6] ..... A62D 3/00; B08B 3/08

[52] U.S. Cl. ..... 588/261; 134/93; 134/166 R; 134/22.13

[58] Field of Search ..... 588/261; 134/3, 134/22.1, 22.11, 22.13, 22.14, 22.17, 22.18, 26, 27, 29, 93, 99.2, 169 R, 166 R; 422/293, 292

[56] References Cited

U.S. PATENT DOCUMENTS

| | | | |
|---|---|---|---|
| 1,049,808 | 1/1913 | Calhoun | 134/93 |
| 1,821,789 | 9/1931 | Borgeson | 134/93 |
| 5,213,623 | 5/1993 | Burtner | 134/22.11 X |

FOREIGN PATENT DOCUMENTS

| | | | |
|---|---|---|---|
| 1038468 | 8/1966 | United Kingdom | 134/93 |
| 2260992 | 5/1993 | United Kingdom | 134/22.13 |

*Primary Examiner*—Ramon S. Britts
*Assistant Examiner*—Frederick L. Lagman
*Attorney, Agent, or Firm*—Pasquale Musacchio; Jerry A. Miller

[57] ABSTRACT

Apparatus for neutralizing a heating element contaminated with acid. A housing is provided which receives water and a base material. The water and base material combine within the housing to form a neutralizing agent. The neutralizing agent is then passed through the heating element in order to neutralize the heating element for safe disposal as municipal waste.

20 Claims, 4 Drawing Sheets

APPARATUS AND METHOD FOR NEUTRALIZING A CONTAMINATED HEATING ELEMENT

FIELD OF THE INVENTION

This invention relates to the manufacture of microprocessors and other semiconductor devices and more particularly, to an apparatus for neutralizing a heating element utilized to heat acid for an etching process.

BACKGROUND OF THE INVENTION

Acid is used in various processes employed in the manufacture of microprocessors and other semiconductor devices. One such process is an etching process in which acid is heated to a predetermined temperature by a heating element. Referring to FIG. 1, a heating element 10 is shown arranged in an overlapping configuration to form a coil 16. The coil 16 is held within a substantially U-shaped casing 18 which is immersed in the acid (not shown). The coil 16 is fabricated from a pair of hollow plastic tubes 14 each of which include a wire 12 connected to a power supply. An electric current causes the coil 16 to increase in temperature and thus heat the acid to a predetermined temperature suitable for etching. One such heating element, also known as an electronic immersion heater, is manufactured by Lufran and designated as model no. SB5-302-A05, although other models are also used. Referring to FIG. 2, a portion of a tube of the heating element 10 is shown. As described previously, each of the tubes 14 are hollow and include a wire 12. Over time, however, it has been found that the tube 14 deteriorates, enabling acid to leak inside of the tube 14, thus necessitating disposal of the tube 14.

It is known that the acid utilized for etching is an environmental pollutant. In order to reduce or eliminate pollution, it is desirable that the acid that has leaked into the heating element 10 be neutralized before the heating element is disposed of as municipal waste. A manual procedure is used to neutralize the heating element 10. This procedure includes manually clipping and slitting apart the tube 14 with knives and/or cutters. The heating element 10 is then placed in a liquid base material for neutralizing the acid.

However, manually clipping and slitting apart the tube 14 is a cumbersome and time consuming operation. In addition, manually clipping and slitting apart of the tube 14 frequently results in the spattering of acid on the operator. The acid and base are hazardous materials and exposure to these materials can be hazardous to the health of operators. Therefore, use of the manual procedure results in exposure to materials which are detrimental to the health of the operators.

SUMMARY OF THE INVENTION

Apparatus for neutralizing a contaminated heating element which includes a housing having an inlet port for receiving water and an outlet port. The apparatus further includes a container connected to the housing for supplying a material to the housing in order to form a neutralizing agent. In addition, the apparatus includes a valve connected between the outlet port and the heating element for supplying to the heating element the neutralizing agent for neutralization of the heating element.

DETAILED DESCRIPTION OF THE INVENTION

Figure 1:
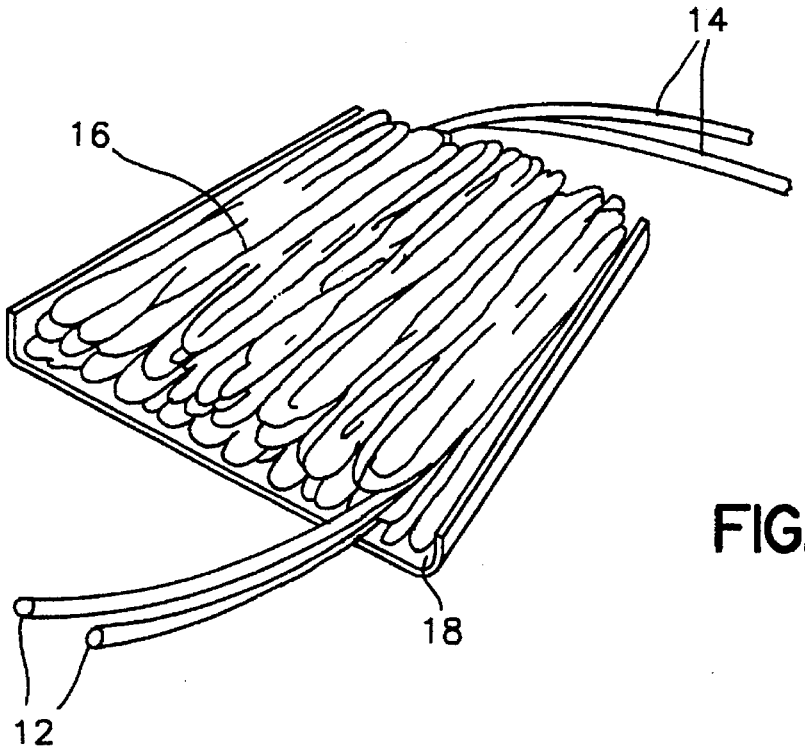
FIG. 1 is a view of a heating element which has been folded into a coil arrangement.
Figure 2:
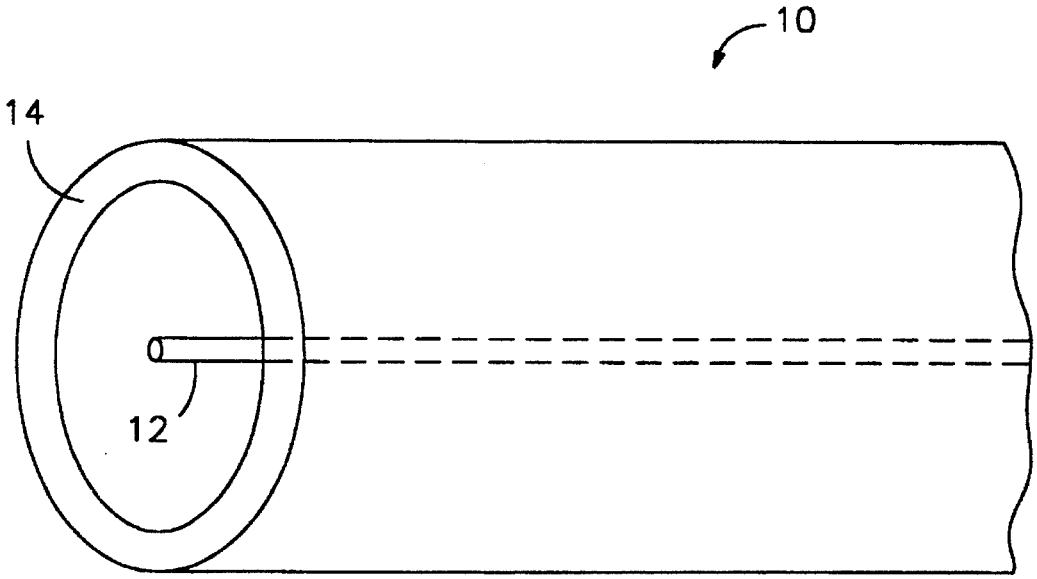
FIG. 2 is a view of a tube of the heating element.

The present invention will now be described by reference to FIGS. 3–5, wherein like elements are designated by like reference numerals.

Figure 3:
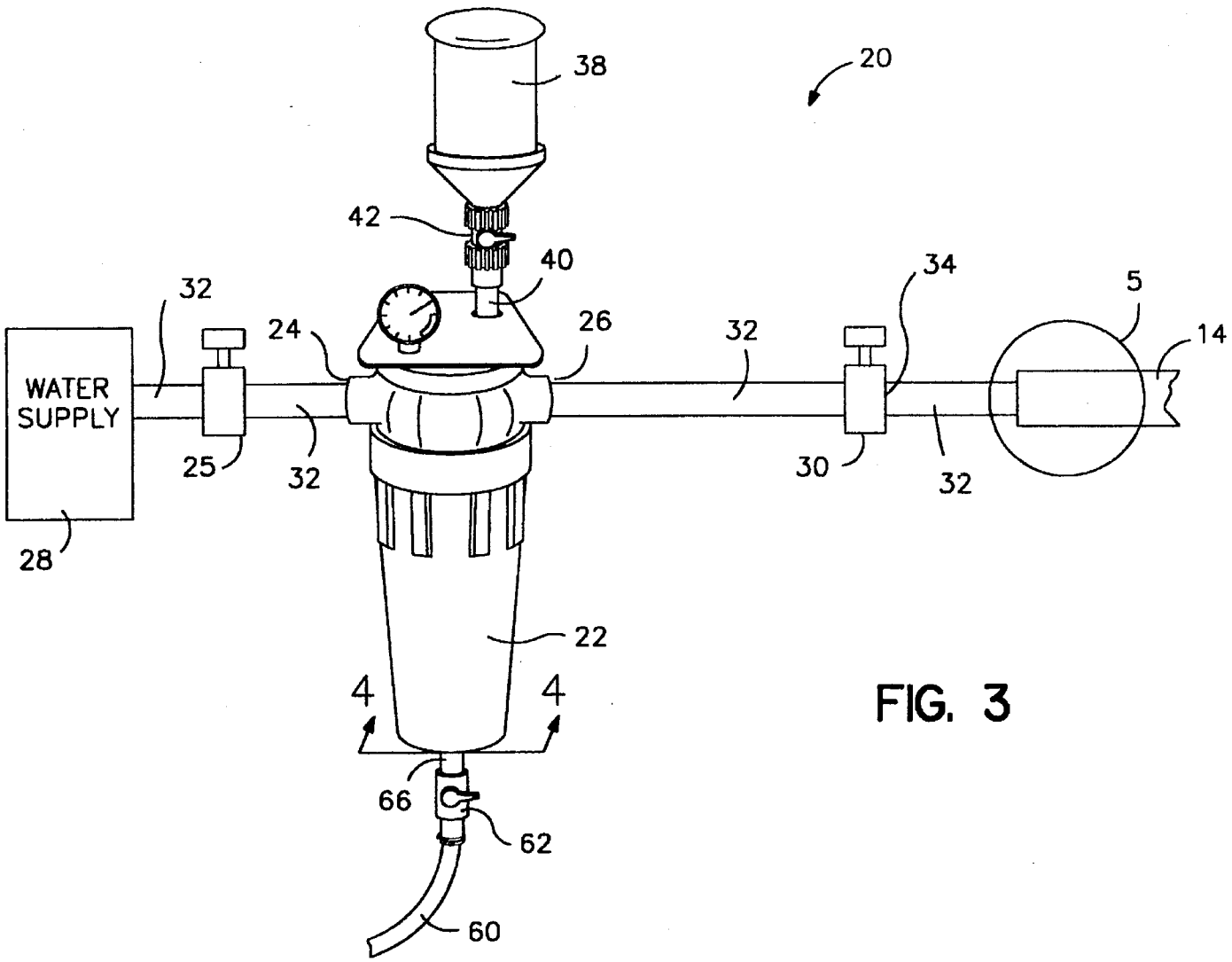
FIG. 3 depicts an apparatus for neutralizing a heating element.

Referring to FIG. 3, an apparatus 20 for neutralizing a heating element 10 is shown. The apparatus 20 includes a housing 22 having an inlet end 24 and a first outlet end 26. The inlet end 24 and the first outlet end 26 are connected to a water supply 28 and to an outlet valve 30, respectively, by pipes 32. A water supply valve 25 is connected between the water supply 28 and the inlet end 24. When the water supply valve 25 is opened, pressurized water from the water supply 28 is introduced into the inlet end 24 of the housing 22.

A container 38 for holding sodium hydroxide (NaOH) or soda ash, is affixed above the housing 22 by a feeder tube 40. The container 38 and feeder tube 40 serve to gravity feed soda ash into the housing 22. The soda ash is ultimately used to form a neutralizing agent for neutralizing acid which has contaminated the heating element 10. A feeder valve 42 is located between the container 38 and the housing 22. The feeder valve 42 serves to introduce soda ash into the housing 22 as required. Accordingly, the operator may introduce an amount of soda ash which is necessary to maintain the neutralizing agent at the desired pH level. Moreover, the container 38 is preferably sized large enough to store an amount of soda ash needed to neutralize one or more acid-contaminated heating elements. Thus, a complete neutralizing operation may be performed without refilling the container 38.

A bottom portion of the housing 22 includes a discharge end 66 having a discharge tube 60 extending therefrom. A discharge valve 62 is connected between the housing 22 and the discharge tube 60. The discharge tube 60 enables discharge of the neutralizing agent directly onto surfaces of objects which require neutralization. Other objects which may be contaminated by acidic fluids in the semiconductor manufacturing process include, for example, filters and gas purge panels. The discharge tube 60 is preferably a flexible member that may be guided by the operator to introduce the neutralizing agent where desired. The rate of discharge of the neutralizing agent through the discharge tube 60 is regulated by manipulating the discharge valve 62.

The outlet valve 30 includes a valve outlet end 34. An end of the tube 14 of the heating element 10 is removably affixed to the valve outlet end 34. In operation, neutralizing agent flows through the outlet valve 30, the valve outlet end 34 and into the heating element 10. The flow of neutralizing agent out of the valve outlet end 34 is regulated by manipulating the outlet valve 30.

Figure 4:
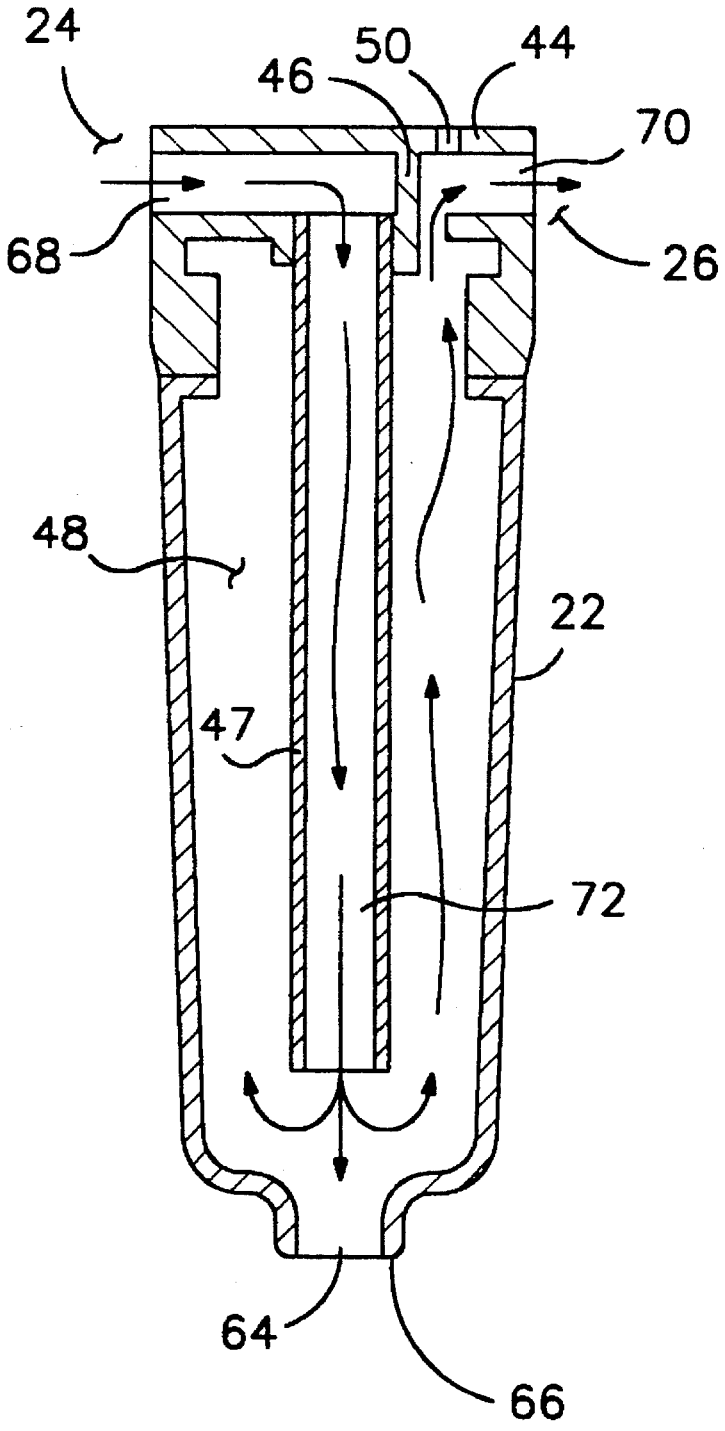
FIG. 4 is a cross sectional view of a housing along section line 4—4 of FIG. 3.

Referring to FIG. 4, a cross sectional view of the housing 22 is shown. The housing 22 includes a cavity 48 and a top cover 44 having a baffle 46 which is positioned within the cavity 48. In addition, the inlet end 24 includes an inlet port 68, the first outlet end 26 includes a first outlet port 70 and the discharge end 66 includes a discharge port 64. The baffle 46 is positioned opposite the inlet port 68 and extends downwardly into the cavity 48. The housing 22 further includes a downwardly extending hollow extension tube 47 located within the cavity 48 between the baffle 46 and the inlet port 68. The tube 47 includes an internal passageway 72 which is in fluid communication with the inlet port 68. The tube 47 serves to direct water toward the bottom of the cavity 48.

The top cover 44 further includes a first inlet aperture 50 positioned to the right of the baffle 46 in FIG. 4. The feeder valve 42 previously described is connected to the first inlet aperture 50. In use, soda ash from the container 38 is introduced into the cavity 48 through the feeder valve 42 and the first inlet aperture 50. The discharge port 64 is used for discharging the neutralizing agent through the discharge valve 62 and discharge tube 60. Any suitable housing may be used, such as that manufactured by Brunswick Technetics and sold under the trademark FLUORO-PLUS, model no. 1DO-10-PFA. It is noted that when the model 1DO-10-PFA housing is utilized, the filter normally included in the housing is removed.

Water (as denoted by arrows) entering from the inlet port 68 is diverted downward into the cavity 48 by the baffle 46 and the extension tube 47. The flow pattern caused by the baffle 46 and extension tube 47 is effective to thoroughly mix the soda ash and water to form the neutralizing agent. The operator may choose to direct the neutralizing agent through either the first outlet port 70 or the discharge port 64. To direct the neutralizing agent through the first outlet port 70, the discharge valve 62 is set closed and the outlet valve 30 is set open. The neutralizing agent is then forced through the first outlet port 70, the outlet valve 30, the valve outlet end 34, pipes 32 and ultimately through the tube 14.

Alternately, to direct the neutralizing agent through the discharge port 64, the discharge valve 62 is set open and the outlet valve 30 is set closed. The neutralizing agent is then forced through the discharge port 64, the discharge valve 62, and ultimately through the discharge tube 60. The operator may further choose to direct the neutralizing agent through both the first outlet port 70 and the discharge port 64 simultaneously. This may be accomplished by setting both the discharge valve 62 and outlet valve 30 open.

Figure 5:
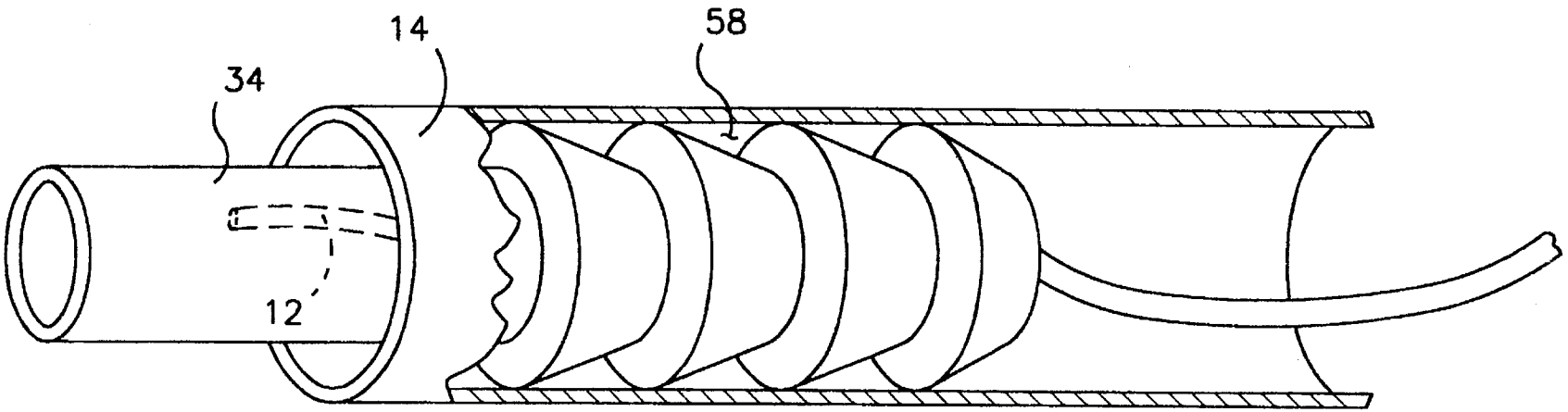
FIG. 5 is an enlarged view of balloon section 5 of FIG. 3.

Referring to FIG. 5, an enlarged cross sectional view of balloon section 5 of FIG. 3 is shown. The valve outlet end 34 includes a plurality of grip elements 58 which serve to removably secure the tube 14 onto the valve outlet end 34. The wire 12 is positioned within the tube 14 and is sufficiently small so that fluid flow through the tube 14 is not substantially affected.

In order to neutralize a heating element 10 or other acid contaminated object, the water supply valve 25 is first closed. This is to inhibit the flow of pressurized water into the container 38 when the feeder valve 42 is opened. It is desirable to drain all or part of the housing 22 before depositing the soda ash in the housing 22 in order to promote better mixing of the water and the soda ash. This is accomplished by opening the discharge valve 62 to allow fluid in the housing 22 to drain through the discharge tube 60. An air bleed port (not shown) may be positioned in the feeder tube 40 to increase the drain rate of the housing. The discharge valve 62 is then closed. A predetermined quantity of soda ash is deposited into the housing 22 by opening the feeder valve 42. The feeder valve 42 is then closed.

When the water supply valve 25 is opened, water from the water supply 28 (water pressure set between 45 to 60 psi) then flows in through the water supply valve 25 and the inlet port 68 into the cavity 48 and combines with soda ash previously deposited in the cavity 48. When the water and soda ash mix, a neutralizing agent having a predetermined pH is created. Typically, the pH of the neutralizing agent is selected to be between 10 and 11, although other suitable values may be obtained by adjusting the amount of soda ash fed into the cavity 48. The neutralizing agent then flows through the first outlet port 70, outlet valve 30, valve outlet end 34, pipes 32 and into the tube 14 for neutralizing acid in the tube 14 and is ultimately discharged from the tube 14. It has been found that passing the neutralizing agent through the tube 14 for approximately 5 minutes is sufficient for neutralizing the tube 14. When the soda ash has been consumed from the cavity, pure water will flow through the tube 14. It is desirable to flow pure water through the tube 14 for approximately 5 minutes in order to remove any residual neutralizing agent. The neutralized heating element 10 is then removed from the valve outlet end 34 of outlet valve 30 and may be safely disposed of as municipal waste.

In this manner, the likelihood that an operator is exposed to a hazardous material is substantially reduced. In addition, the present invention substantially reduces the amount of time that is required to neutralize a contaminated heating element. As noted, the neutralizing agent may be discharged from the housing 22 simultaneously through the first outlet port 26 and the second outlet port 64. Other outlet configurations may be employed as required to deliver the neutralizing agent. For example, the housing 22 may include additional outlets for use in neutralizing a plurality of heating tubes or other acid contaminated objects. Alternately, the first outlet port 70 or the discharge port 64 may be branched into multiple paths to deliver the neutralizing agent to multiple locations.

While the invention has been described in conjunction with specific embodiments, it is evident that many alternatives, modifications, permutations and variations will become apparent to those skilled in the art in light of the foregoing description. Accordingly, it is intended that the present invention embraces all such alternatives, modifications and variations as fall within the scope of the appended claims.

What is claimed is:

1. An apparatus for neutralizing a contaminated heating element, comprising:

a housing having an inlet port for receiving water;

a container for holding a material;

a valve connected between said container and said housing for supplying a predetermined amount of said material to said water in said housing wherein said water and said material form a neutralizing agent; and a conduit connected to said housing for supplying said neutralizing agent to said heating element for neutralizing said heating element.

2. The apparatus according to claim 1, wherein said material is a base.

3. The apparatus according to claim 2, wherein said base is sodium hydroxide.

4. The apparatus according to claim 1, wherein the pH factor of said neutralizing agent is between approximately 10 and 11.

5. The apparatus according to claim 1, wherein said heating element is contaminated by an acid etching solution.

6. An apparatus for neutralizing at least one contaminated element, comprising:

a housing having an inlet port for receiving water;

a container for holding a material;

valve means connected between said container and said housing for supplying a predetermined amount of said material to said water in said housing wherein said water and said material form a neutralizing agent;

first conduit means connected to said housing for supplying said neutralizing agent to a first element for neutralizing said first element; and second conduit means connected to said housing for supplying said neutralizing agent to a second element for neutralizing said second element.

7. The apparatus according to claim 6, wherein said material is a base.

8. The apparatus according to claim 7, wherein said base is sodium hydroxide.

9. The apparatus according to claim 6, wherein the pH factor of said neutralizing agent is between approximately 10 and 11.

10. The apparatus according to claim 6, wherein said heating element is contaminated by an acid etching solution.

11. An apparatus for neutralizing a contaminated heating element having a tube which includes a wire and a second element, comprising:

a housing having an inlet port for receiving water, wherein said inlet port is connected to a water supply;

a container for holding a material;

a first valve connected between said container and said housing for supplying a predetermined amount of said material to said water in said housing wherein said water and said material form a neutralizing agent;

a first conduit connected to said housing for providing a first flow of said neutralizing agent to said heating element for neutralizing said heating element;

a second valve connected to said first conduit for controlling said first flow of said neutralizing agent to said heating element;

a second conduit connected to said housing for providing a second flow of said neutralizing agent to said second element;

a third valve connected to said second conduit for controlling said second flow of said neutralizing agent to said second element; and a fourth valve connected between said water supply and said inlet port for controlling flow of water to said housing.

12. The apparatus according to claim 11 wherein said material is a base.

13. The apparatus according to claim 11, wherein said base is sodium hydroxide.

14. The apparatus according to claim 11, wherein the pH factor of said neutralizing agent is between approximately 10 and 11.

15. The apparatus according to claim 11, wherein said heating element is contaminated by an acid etching solution.

16. A method for neutralizing a contaminated heating element, comprising the steps of:

feeding a material into a container by controlling a valve;

feeding water into said container;

mixing said material with said water in said container to form a neutralizing agent;

discharging said neutralizing agent from said container;

passing said neutralizing agent through said heating element for approximately 5 minutes to neutralize said heating element; and passing water through said heating element for approximately 5 minutes to remove residual neutralizing agent from said heating element.

17. The method according to claim 16, wherein said material is a base.

18. The method according to claim 16, wherein said base is sodium hydroxide.

19. The method according to claim 16, wherein the pH factor of said neutralizing agent is between approximately 10 and 11.

20. The method according to claim 16, wherein said heating element is contaminated by an acid etching solution.

* * * * *